US009212557B2

(12) United States Patent
Benjamin et al.

(10) Patent No.: US 9,212,557 B2
(45) Date of Patent: Dec. 15, 2015

(54) ASSEMBLY AND METHOD PREVENTING TIE SHAFT UNWINDING

(75) Inventors: Daniel Benjamin, Simsbury, CT (US); Roger Gates, West Hartford, CT (US); Brian C. Lund, Moodus, CT (US)

(73) Assignee: UNITED TECHNOLOGIES CORPORATION, Hartford, CT (US)

( * ) Notice: Subject to any disclaimer, the term of this patent is extended or adjusted under 35 U.S.C. 154(b) by 1084 days.

(21) Appl. No.: 13/222,190

(22) Filed: Aug. 31, 2011

(65) Prior Publication Data

US 2013/0051985 A1 Feb. 28, 2013

(51) Int. Cl.
*F02C 7/36* (2006.01)
*F01D 5/06* (2006.01)

(52) U.S. Cl.
CPC ..... *F01D 5/066* (2013.01); *Y10T 29/4932* (2015.01)

(58) Field of Classification Search
CPC ..... F01D 5/066; Y10T 29/4932; F02C 3/00; F02C 7/36
USPC ..... 415/198.1, 199.4, 199.5; 416/198 A, 416/198 R, 204 A; 29/889.2
See application file for complete search history.

(56) References Cited

U.S. PATENT DOCUMENTS 3,528,241 A 9/1970 Venable et al.
3,823,553 A 7/1974 Smith
3,976,399 A 8/1976 Schmoch
4,057,371 A 11/1977 Pilarczyk
4,123,199 A 10/1978 Shimizu et al.
4,247,256 A 1/1981 Maghon
4,611,464 A 9/1986 Hetzer et al.
4,915,589 A 4/1990 Gessler et al.
4,934,140 A 6/1990 Dennison et al.
4,944,660 A 7/1990 Joco
5,220,784 A 6/1993 Wilcox
5,537,814 A 7/1996 Nastuk et al.
5,653,581 A 8/1997 Dixon et al.
6,206,642 B1 3/2001 Matheny et al.
6,312,221 B1 11/2001 Yetka et al.
6,663,346 B2 12/2003 Munsell et al.
2006/0130456 A1 6/2006 Suciu et al.
2006/0130488 A1 6/2006 Suciu et al.
2007/0107219 A1 5/2007 Suciu et al.
2009/0025461 A1 1/2009 Walters et al.

*Primary Examiner* — Edward Look
*Assistant Examiner* — Maxime Adjagbe
(74) *Attorney, Agent, or Firm* — Carlson, Gaskey & Olds, PC

(57) ABSTRACT

A gas turbine engine has a plurality of compressor rotors, as well as a plurality of turbine rotors. A tie shaft of the engine is constrained to rotate with the compressor and turbine rotors during normal operating conditions. Further, an upstream hub is in threaded engagement with the tie shaft. The threads of the upstream hub are handed in a first manner when viewed from an upstream location. A downstream abutment member is positioned downstream of the turbine rotors and is also in threaded engagement with the tie shaft. Threads of the downstream abutment member are handed in the first manner when viewed from a downstream location. Accordingly, the compressor and turbine sections of the engine are reliably held together, and the tie shaft is substantially prevented from unwinding.

19 Claims, 4 Drawing Sheets

ASSEMBLY AND METHOD PREVENTING TIE SHAFT UNWINDING

BACKGROUND

This application relates to a gas turbine engine including compressor and turbine rotors assembled using a tie shaft connection.

Gas turbine engines are known, and typically include a compressor, which compresses air and delivers it downstream into a combustion section. The air is mixed with fuel in the combustion section and combusted. Products of this combustion pass downstream over turbine rotors, causing the turbine rotors to rotate.

Typically, the compressor section is provided with a plurality of rotor serial stages, or rotor sections. Traditionally, these stages were joined sequentially, one to another, into an inseparable assembly by welding, or into a separable assembly by bolting using bolt flanges, or other structure to receive the attachment bolts.

More recently, it has been proposed to eliminate the welded or bolted joints with a single coupling which applies an axial force, or pre-load, through the compressor and turbine rotors to hold them together and create the friction necessary to transmit torque. While not prior art, some of these assemblies have experienced an unwinding condition where that pre-load is substantially reduced or lost altogether.

SUMMARY

A gas turbine engine has a plurality of compressor rotors, as well as a plurality of turbine rotors. A tie shaft of the engine is constrained to rotate with the compressor and turbine rotors during normal operating conditions. Further, an upstream hub is located upstream of the compressor rotors and is in threaded engagement with the tie shaft. The threads of the upstream hub are handed in a first manner when viewed from an upstream location. A downstream abutment member is positioned downstream of the turbine rotors and is also in threaded engagement with the tie shaft. The threads of the downstream abutment member are handed in the first manner when viewed from a downstream location. Further disclosed is a method of assembling the gas turbine engine.

These and other features of the present disclosure can be best understood from the following specification and drawings, the following of which is a brief description.

BRIEF DESCRIPTION OF THE DRAWINGS

The drawings can be briefly described as follows.

DETAILED DESCRIPTION

Figure 1:
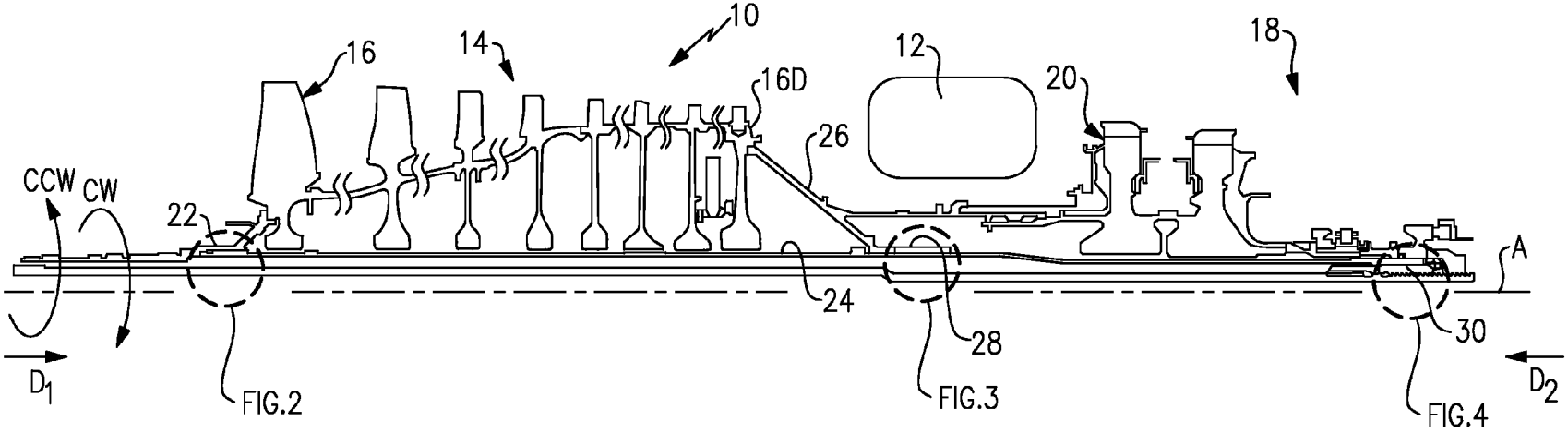
FIG. 1 schematically shows a portion of an exemplary gas turbine engine.

FIG. 1 schematically shows an exemplary section of a gas turbine engine 10, in particular a high pressure spool, incorporating a combustion section 12, shown schematically, a compressor section 14 having a plurality of compressor rotors 16 defining a compressor stack, and a turbine section 18 having a plurality of turbine rotors 20 defining a turbine stack. As shown, an upstream hub 22 has a threaded engagement with a tie shaft 24 upstream of the compressor rotors 16. Notably, there may be a low pressure compressor, and a fan section, to the left (or upstream) of the upstream hub 22.

A downstream hub 26 is positioned at a downstream side of the compressor stack, and contacts a downstream-most compressor rotor 16D. The stack of compressor rotors is thus sandwiched between the upstream and downstream hubs 22, 26, and is secured by a mid lock nut, or mid abutment member, 28. Downstream hub 26 abuts the turbine stack, which is held against a turbine lock nut, or abutment member, 30. A low pressure turbine may be arranged to the right (or downstream) of the turbine lock nut 30. The mid and turbine lock nuts 28, 30 and the upstream hub 22 are in threaded engagement with the tie shaft 24, as discussed with reference to FIGS. 2-4, below.

Figure 2:
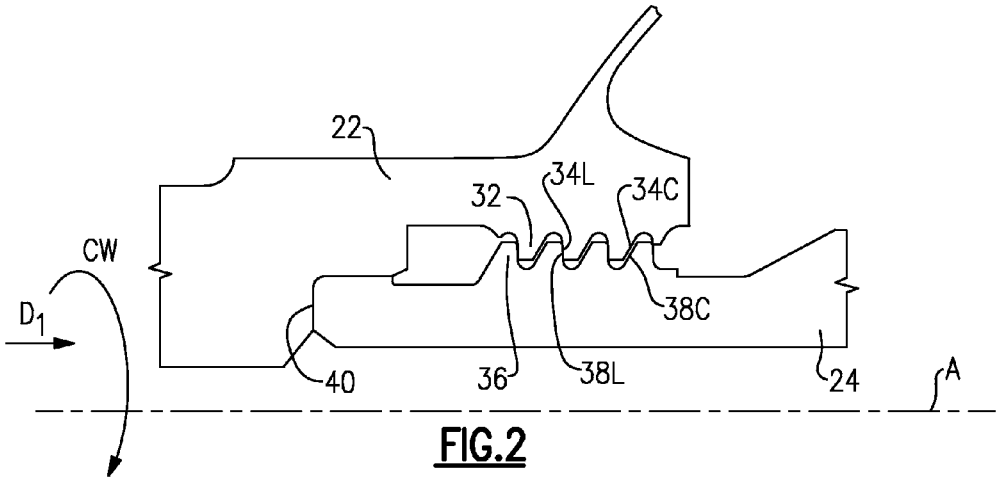
FIG. 2 is a close-up view of the designated area in FIG. 1.

Referring to FIG. 2, the upstream hub 22 may include a plurality of threads 32 having load flanks 34L and clearance flanks 34C. The tie shaft 24 may thus include complementary front threads 36 having load flanks 38L and clearance flanks 38C. After assembly, the load flanks 34L, 38L abut one another, as shown, such that the upstream hub 22 applies a load toward the compressor stacks. The load flanks 34L, 38L are generally perpendicular to the engine axis A, and may be inclined approximately 3° relative to the perpendicular to provide an adequate contact surface between load flanks 34L, 38L. The clearance flanks 34C, 38C, on the other hand, may be inclined approximately 30° relative to the perpendicular. These angles of inclination may be varied as desired, and are simply exemplary.

Notably, and in the example shown, the threads 32, 36 are right-handed threads. That is, viewing the upstream hub 22 from an upstream location (e.g., from left to right in FIG. 2), clockwise CW rotation of the upstream hub 22 relative to the tie shaft 24 urges the upstream hub 22 in direction $D_1$ relative to the tie shaft 24. In FIG. 2, however, this relative movement of the upstream hub 22 is prevented by contact between the tie shaft 24 and the abutment point 40 of the upstream hub 22. The pitch of the threads 32, 36 may be 12 TPI (threads-per-inch) (roughly 4.7 threads-per-cm). This TPI is simply an example.

Figure 3:
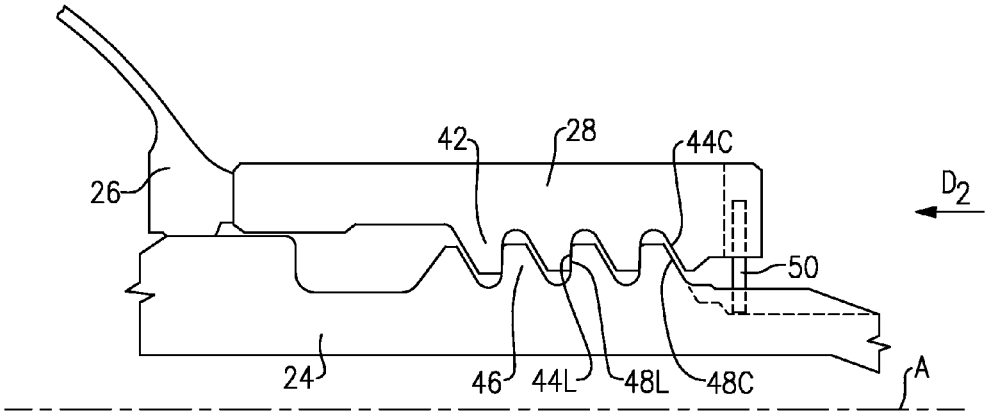
FIG. 3 is a close-up view of the designated area in FIG. 1.

FIG. 3 shows the engagement between the tie shaft 24 and the mid lock nut 28. As mentioned above, the downstream hub 26 and the mid lock nut 28, in combination with the upstream hub 22, are arranged to provide a pre-load to the compressor stage. The shown mid lock nut 28 is threaded onto the tie shaft 24 from a direction $D_2$, and includes right-handed threads 42 (e.g., the threads are right-handed when viewed from a downstream location, or from right-to-left in FIG. 3). Mid threads 46 of the tie shaft 24 may be similarly handed to correspond to the threads 42. After assembly, the load flank 44L of the threads 42 abuts the load flank 48L of the mid threads 46. The pitch of the threads 42, 46 may be selected to be coarser than that of the threads 32, 36, such as 10 TPI (roughly 3.9 threads-per-cm). Again, this TPI is simply an example. An optional lock washer 50 may be utilized for added safety.

Figure 4:
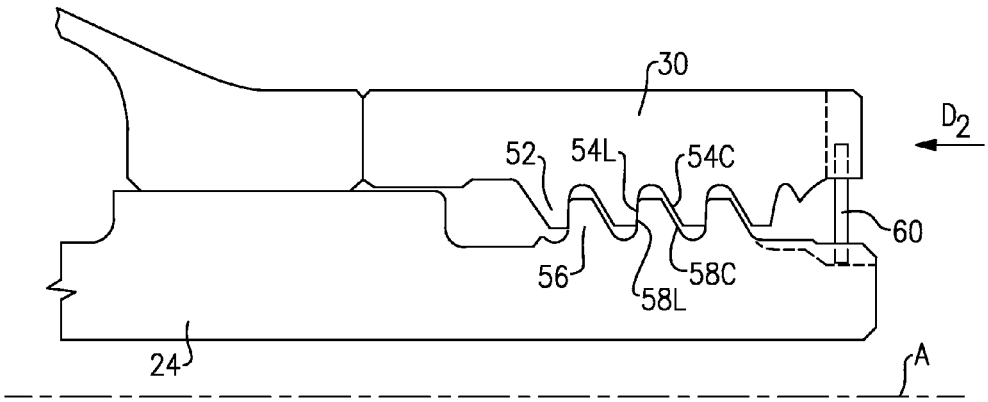
FIG. 4 is a close-up view of the designated area in FIG. 1.

FIG. 4 shows the turbine lock nut 30 in threaded engagement with the tie shaft 24 at a point downstream of the turbine stack. Similar to the mid lock nut 28, the turbine lock nut may also be threaded onto the tie shaft from a direction $D_2$ and includes right-handed threads. Threads 52 of the turbine lock nut 30 may further include load flanks 54 configured to abut load flanks 58 of the turbine threads 56 of the tie shaft 24. An optional lock washer 60 may be used in connection with the turbine lock nut 30.

Similar to the threads 42, 46, the threads 52, 56 may be coarser than the threads 32, 36. As shown, the pitch of the threads 52, 56 is 10 TPI (roughly 3.9 threads-per-cm). Again, this TPI is exemplary. As will be appreciated from the exemplary assembly method shown in FIGS. 5-6, the turbine lock nut 30, in combination with the upstream hub 22, is responsible for a significant portion of the pre-load on the compressor and turbine stacks.

Further, the clearance flanks 46C, 48C and 54C, 58C may be inclined at an angle of approximately 45° relative to a direction perpendicular to the engine axis A. The load flanks 46L, 48L, 54L, 58L may be arranged closer to the perpendicular direction, such as being inclined at approximately 7° thereto. Again, these angles are examples.

Figure 5:
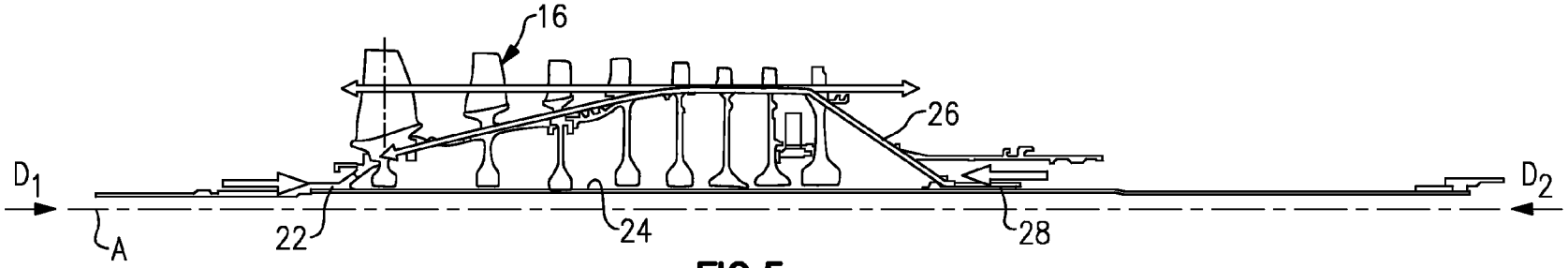
FIG. 5 shows a first step in the assembly of the portion of the engine of FIG. 1.
Figure 6:
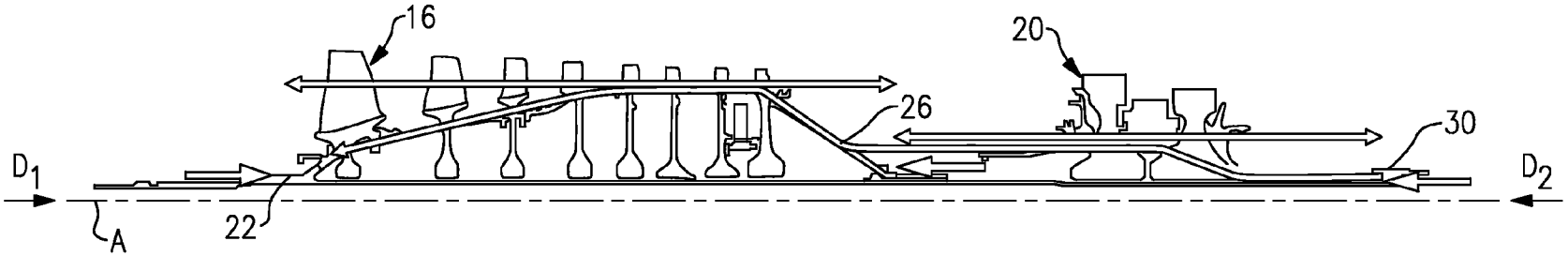
FIG. 6 shows a second step in the assembly of the portion of the engine of FIG. 1.

FIGS. 5-6 show the assembly sequence of the gas turbine engine 10 with the disclosed arrangement. The single headed arrows shown in these Figures illustrate an applied force, while the double-headed arrows illustrate internal forces. As shown in FIG. 5, initially, the upstream hub 22 is assembled, by way of threads, to the tie shaft 24 while the compressor rotors 16 and downstream hub 26 are stacked together using the mid lock nut 28 to apply an axial pre-load force holding the rotors against the upstream hub 22 and ensuring the necessary friction to transmit torque. An internal compression load will be created in the rotors stack to react the tension load in the tie shaft 24 (e.g., as a consequence of applying successive stretches to the tie shaft 24 and the relevant rotor stack, then constraining the assembly by locking the nuts 28 and 30).

As shown in FIG. 6, the subsequent step includes assembling the turbine rotors 20, and using turbine lock nut 30 to secure the new assembly by applying an axial pre-load force holding the compressor and turbine rotors 16, 20 together and ensuring the necessary friction to transmit torque. A secondary load path is created with internal compression load in the turbine stack and tension load in the downstream end of the tie shaft 24; the internal compression load in the compressor rotors stack is also augmented. Notably, the majority of the pre-load applied to the compressor and turbine rotors 16, 20 is carried by the upstream hub 22 and the turbine lock nut 30. While the mid lock nut 28 does carry some of that overall pre-load, the mid lock nut 28 is primarily useful during assembly of the compressor stage.

While not shown, an additional nut may be driven to hold a bearing and seal package against the turbine rotors 20 and augment the final stack preload to ensure the necessary friction to transmit torque. Alternatively, the turbines can be held together by the lock nut 30 alone.

Figure 7:
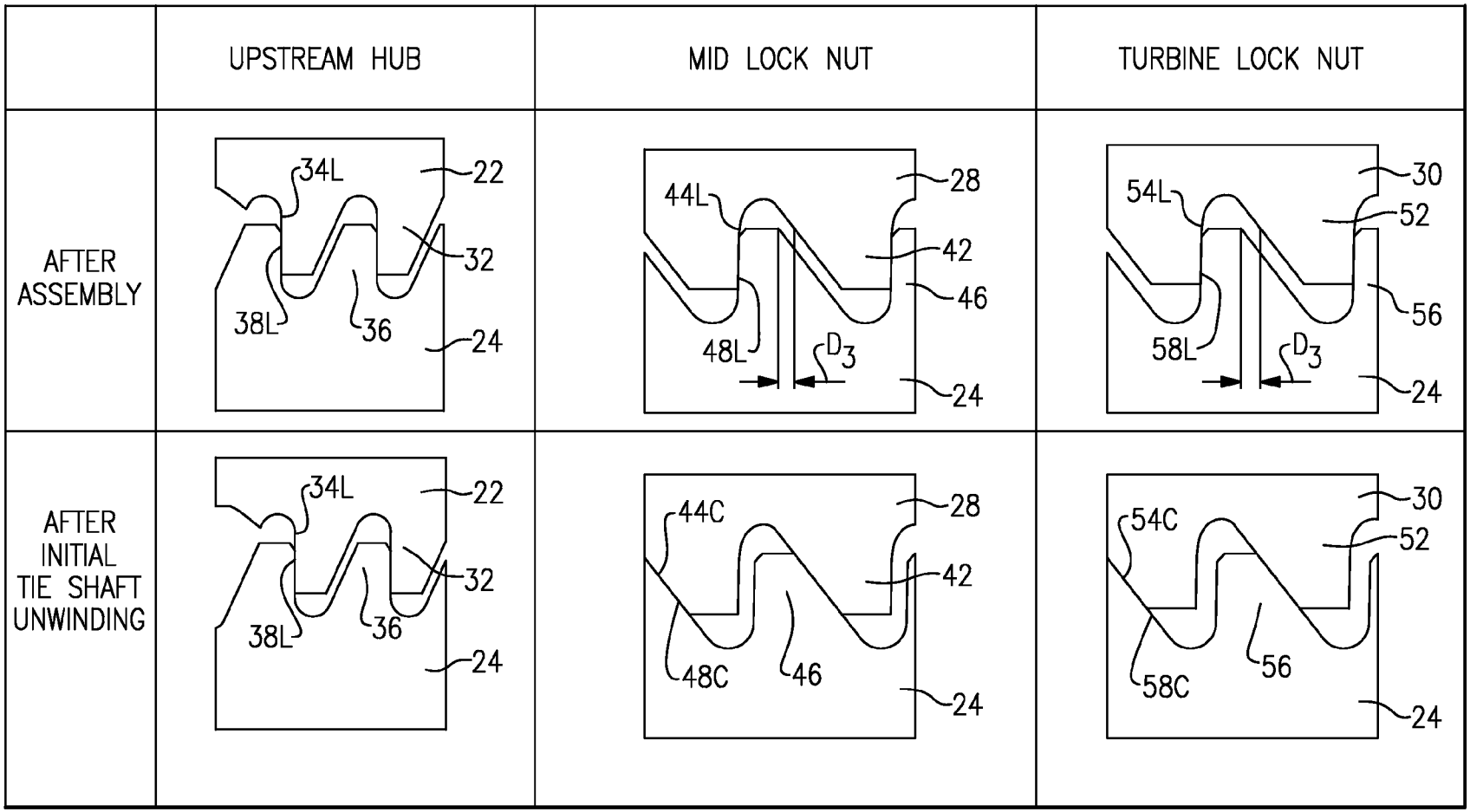
FIG. 7 is a chart representing the arrangement of the threaded joints of FIGS. 2-4 after (1) assembly and (2) initial tie shaft unwinding.

FIG. 7 is a chart representative of the threaded joints of FIGS. 2-4 after both (1) assembly and (2) initial tie shaft unwinding. In the row labeled "After Assembly," the threaded joints are positioned in the same manner shown in FIGS. 2-4. Notably, in this position the load flanks 34L, 38L, 44L, 48L, 54L and 58L of the respective threads abut one another to maintain a pre-load on the compressor and turbine stacks. The threaded joints will also be in this position during normal engine operating conditions. That is, during normal engine operating conditions, the upstream hub 22, the mid lock nut 28 and the turbine lock nut 30 are configured to rotate with the tie shaft 24. In the example of FIG. 1, the turbine engine 10 is configured for counter-clockwise CCW rotation about the engine axis A, and thus the upstream hub 22, the lock nuts 28, 30 and the tie shaft 24 all rotate together in the counter-clockwise CCW direction. Notably, the clockwise and counter-clockwise CW, CCW conventions used herein are used to aid in understanding of this disclosure and should not be interpreted as contradicting any other accepted conventions.

In an attempted tie shaft unwinding condition (e.g., during a sudden deceleration, or "snap" deceleration, of the turbine engine 10), the tie shaft may rotate clockwise CW relative to the counter-clockwise CCW rotation of the turbine engine 10, upstream hub 22 and the lock nuts 28, 30. Given the right-handed orientation of the threads 32, 36 of the upstream hub 22, this relative rotation will urge the tie shaft 24 in a direction $D_1$ generally away from the upstream hub 22. However, due to the arrangement of the lock nuts 28, 30 relative to the tie shaft 24 (including the handedness and the pitch of the threads 42, 46, 52, 56), the relative clockwise CW rotation of the tie shaft 24 actually tightens the lock nuts 28, 30 relative to the tie shaft 24 and prevents the tie shaft from unwinding from the upstream hub 22. That is, the coarser threads 42, 46, 52, 56 urge the tie shaft 24 further in direction $D_2$ than the finer threads 32, 36 urge the tie shaft 24 in the direction $D_1$. Stated another way, the finer threads 32, 36 attempt to move the tie shaft 24 more slowly than the coarser threads 42, 46, 52, 56 would otherwise allow.

While the tie shaft 24 may axially move a distance $D_3$ between the clearance flanks 44C, 48C, 54C, 58C, this axial movement is relatively minor, and will not result in any substantial loss in pre-load. In fact, the relative positions of the upstream hub 22 and the lock nuts 28, 30 remain substantially unchanged, even after the initial unwinding of the tie shaft 24, and therefore the pre-load is substantially maintained. Instead of unwinding altogether, the disclosed arrangement limits axial movement of the tie shaft 24 to the distance $D_3$. Once the tie shaft 24 moves this relatively small distance, the lock nuts 28, 30 urge the tie shaft 24 in a direction $D_2$ by way of engagement of the clearance flanks 44C, 48C, 54C, 58C, as represented in the row labeled "After Initial Tie Shaft Unwinding."

While the threads 32, 36 have been shown and described as right-handed threads (when viewed from an upstream location) and the threads 42, 46, 52, 56 have been shown and described as being right-handed threads (when viewed from a downstream location) it is possible that the handedness of the threads could be reversed. That is, in a contemplated embodiment the threads 32, 36 could be left-handed when viewed from upstream, and the threads 42, 46, 52, 56 could be left-handed when viewed from downstream. In either case, the lock nuts 28, 30 would substantially prevent unwinding of the tie shaft 24 relative to the upstream hub 22.

Further, while it has been mentioned that the threads 32, 36 may have a pitch of 12 TPI and the threads 42, 46, 52, 56 may have a coarser pitch of 10 TPI, other pitch combinations are contemplated herein, including other combinations whether the threads 32, 36 have a finer pitch that the threads 42, 46, 52, 56.

The disclosed arrangement ensures that the compressor and turbine sections 14, 18 are reliably held together, and will be capable to resist the forces to be encountered during use, while still transmitting the necessary engine torque. In particular, the tie shaft is substantially prevented from unwinding, thus retaining the pre-load in the overall engine assembly, even in an attempted tie shaft unwinding condition. All these functions are accomplished within a minimal axial envelope and with the lowest locking hardware count.

One of ordinary skill in this art would understand that the above-described embodiments are exemplary and non-limiting. That is, modifications of this disclosure would come within the scope of the claims. Accordingly, the following claims should be studied to determine their true scope and content.

What is claimed is:

1. A gas turbine engine comprising:

a plurality of compressor rotors;

a plurality of turbine rotors;

a tie shaft, the compressor and turbine rotors being constrained to rotate with the tie shaft in a normal operating condition;

an upstream hub located upstream of the compressor rotors, the upstream hub in threaded engagement with the tie shaft, threads of the upstream hub handed in a first manner when viewed from an upstream location; and a downstream abutment member located downstream of the turbine rotors, the downstream abutment member in threaded engagement with the tie shaft, threads of the downstream abutment member handed in the first manner when viewed from a downstream location;

wherein the tie shaft includes a first set of threads corresponding to the threads of the upstream hub and a second set of threads corresponding to the threads of the downstream abutment member, and wherein threads of the upstream hub, the threads of the downstream abutment member, and the first and second sets of threads each include load flanks and clearance flanks;

wherein, when in an initial assembled condition, the load flanks of the upstream hub contact the load flanks of the first set of threads, and the load flanks of the downstream abutment member contact the load flanks of the second set of threads; and wherein, when in an attempted unwinding condition, the load flanks of the upstream hub contact the load flanks of the first set of threads, and the clearance flanks of the downstream abutment member contact the clearance flanks of the second set of threads.

2. The gas turbine engine of claim 1, wherein the threads of the upstream hub are right-handed when viewed from the upstream location.

3. The gas turbine engine of claim 1, wherein the threads of the downstream abutment member are right-handed when viewed from the downstream location.

4. The gas turbine engine of claim 1, wherein a pitch of the threads of the upstream hub is finer than a pitch of the threads of the downstream abutment member.

5. The gas turbine engine of claim 4, wherein the pitch of the threads of the upstream hub is 12 threads per inch, and wherein the pitch of the threads of the downstream abutment member is 10 threads per inch.

6. The gas turbine engine of claim 1, further including a mid abutment member positioned downstream of the compressor rotors and upstream of the turbine rotors, the mid abutment member in threaded engagement with the tie shaft, threads of the mid abutment member handed in the first manner when viewed from a downstream location.

7. The gas turbine of claim 6, wherein both of the upstream hub and the mid abutment member are tightened toward the compressor rotors.

8. The gas turbine engine of claim 1, wherein the downstream abutment member is tightened toward the turbine rotors.

9. The gas turbine engine of claim 1, wherein, when in the attempted unwinding condition, the downstream abutment member prevents the tie shaft from unwinding relative to the upstream hub.

10. A method of assembling a gas turbine engine comprising the steps of:

(a) assembling a plurality of compressor rotors onto a tie shaft;

(b) assembling an upstream hub at an upstream end of the compressor rotors, the upstream hub in threaded engagement with the tie shaft, threads of the upstream hub handed in a first manner when viewed from an upstream location;

(c) assembling a plurality of turbine rotors onto the tie shaft;

(d) forcing a downstream abutment member against a downstream end of the turbine rotors, the downstream abutment member in threaded engagement with the tie shaft, threads of the downstream abutment member handed in the first manner when viewed from a downstream location;

wherein the tie shaft includes a first set of threads corresponding to the threads of the upstream hub and a second set of threads corresponding to the threads of the downstream abutment member, and wherein threads of the upstream hub, the threads of the downstream abutment member, and the first and second sets of threads each include load flanks and clearance flanks;

wherein, when in an initial assembled condition, the load flanks of the upstream hub contact the load flanks of the first set of threads, and the load flanks of the downstream abutment member contact the load flanks of the second set of threads; and wherein, when in an attempted unwinding condition, the load flanks of the upstream hub contact the load flanks of the first set of threads, and the clearance flanks of the downstream abutment member contact the clearance flanks of the second set of threads.

11. The method of claim 10, wherein the threads of both the upstream hub and the downstream abutment member are right-handed threads when viewed from upstream and downstream locations, respectively.

12. The method of claim 10, further including the step of: forcing the turbine rotors against the upstream hub to hold the turbine rotors.

13. The method of claim 10, further including the step of: assembling a mid abutment member at a location downstream of the upstream hub, the mid abutment member applying a force to hold the compressor rotors against the upstream hub.

14. The method of claim 13, wherein each of the upstream hub, mid abutment member, and downstream abutment member applies a force to their respective rotors.

15. The gas turbine engine of claim 1, wherein each of the load flanks are oriented generally perpendicular to an engine central longitudinal axis.

16. The gas turbine engine of claim 15, wherein the clearance flanks are inclined approximately 30 degrees relative to a direction perpendicular to the engine central longitudinal axis.

17. The method of claim 10, wherein each of the load flanks are oriented generally perpendicular to an engine central longitudinal axis.

18. The method of claim 17, wherein the clearance flanks are inclined approximately 30 degrees relative to a direction perpendicular to the engine central longitudinal axis.

19. The method of claim 10, wherein a pitch of the threads of the upstream hub is finer than a pitch of the threads of the downstream abutment member.

* * * * *